United States Patent [19]

Coats

[11] 4,020,726

[45] May 3, 1977

[54] SHEET ROLL SPLITTER HAVING HORIZONTAL CUTTER

[75] Inventor: John N. Coats, Lake Oswego, Oreg.

[73] Assignee: Industrial Research & Engineering, Inc., Portland, Oreg.

[22] Filed: Jan. 23, 1976

[21] Appl. No.: 651,637

[52] U.S. Cl. ..... 83/397; 83/54; 83/527; 83/530; 83/639; 83/924; 83/928

[51] Int. Cl.[2] ..... B26D 5/04

[58] Field of Search ..... 30/124, 379, 379.5; 83/54, 188, 924, 928, 397, 530, 639, 527

[56] References Cited

UNITED STATES PATENTS

| | | | |
|---|---|---|---|
| 3,160,044 | 12/1964 | Somerville | 83/54 X |
| 3,407,856 | 10/1968 | Ritchie | 144/193 A |
| 3,640,323 | 2/1972 | Helle | 144/193 A |
| 3,675,525 | 7/1972 | Ellison | 83/924 X |
| 3,779,295 | 12/1973 | Balsbaugh | 144/193 A |
| 3,796,120 | 3/1974 | Wolfberg | 83/54 X |
| 3,827,328 | 8/1974 | LaFlamme | 83/639 X |
| 3,937,260 | 2/1976 | Anderson | 144/193 A |

*Primary Examiner*—J. M. Meister

*Attorney, Agent, or Firm*—Klarquist, Sparkman, Campbell, Leigh, Hall & Whinston

[57] ABSTRACT

A roll splitter apparatus is described for splitting a roll of paper or other sheet material using a cutter blade which moves substantially horizontally toward the roll core. A pair of generally horizontal extending holding arms are provided with hooks on the ends of such arms which engage a shaft extending through the core of the sheet roll to hold such roll while the cutter blade is moved radially inward toward the core to cut the roll. The cutter blade is driven by a fluid cylinder and has guide members which slide along the holding arms to guide the movement of such blade. The holding arms and blade are raised and lowered by means of another fluid cylinder in order to accommodate rolls of different diameter. A knife guard is provided which covers the cutter blade in its retracted position, such guard being raised and lowered by cams provided on the blade. The entire roll splitter apparatus is mounted on a wheeled cart for mobility, such that the apparatus can be positioned adjacent the paper machine from which the unused rolls are taken and split before being turned back into pulp.

12 Claims, 5 Drawing Figures

FIG. 1
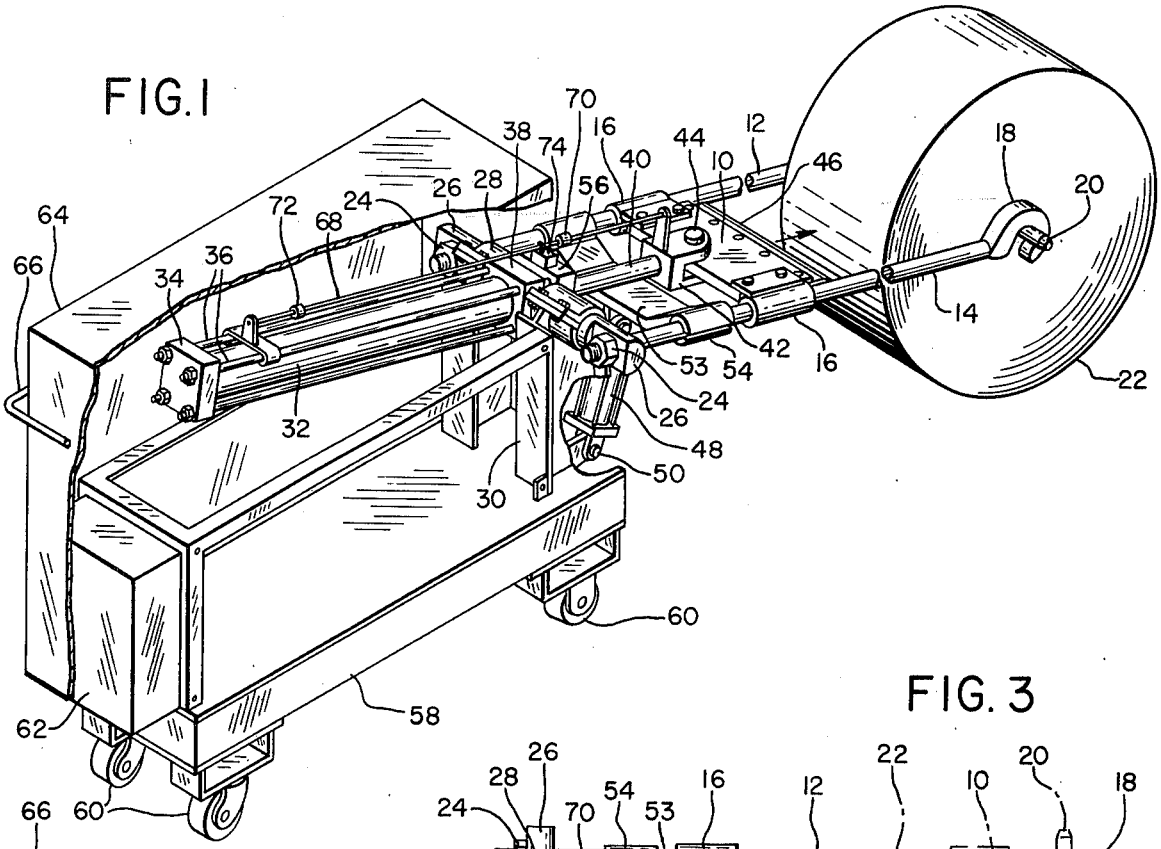
FIG. 3
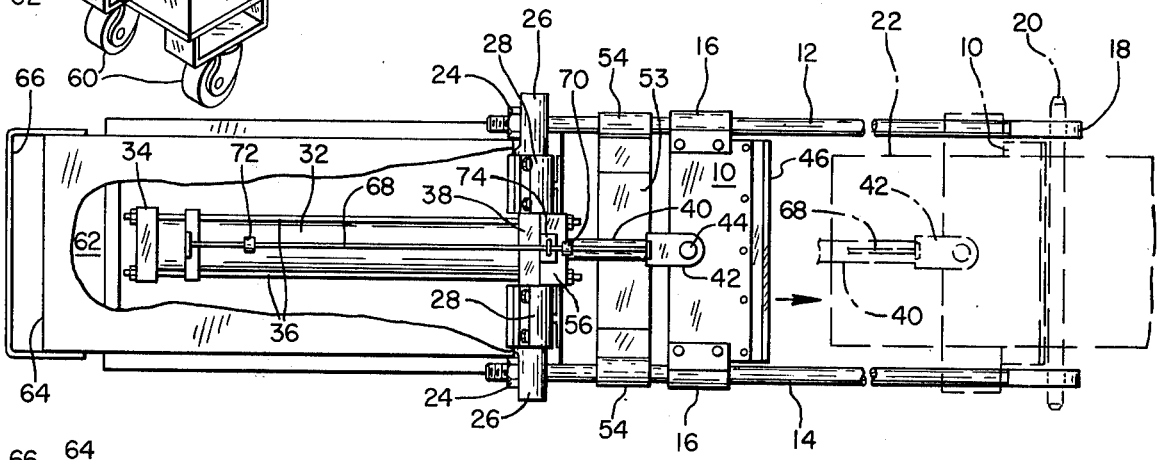
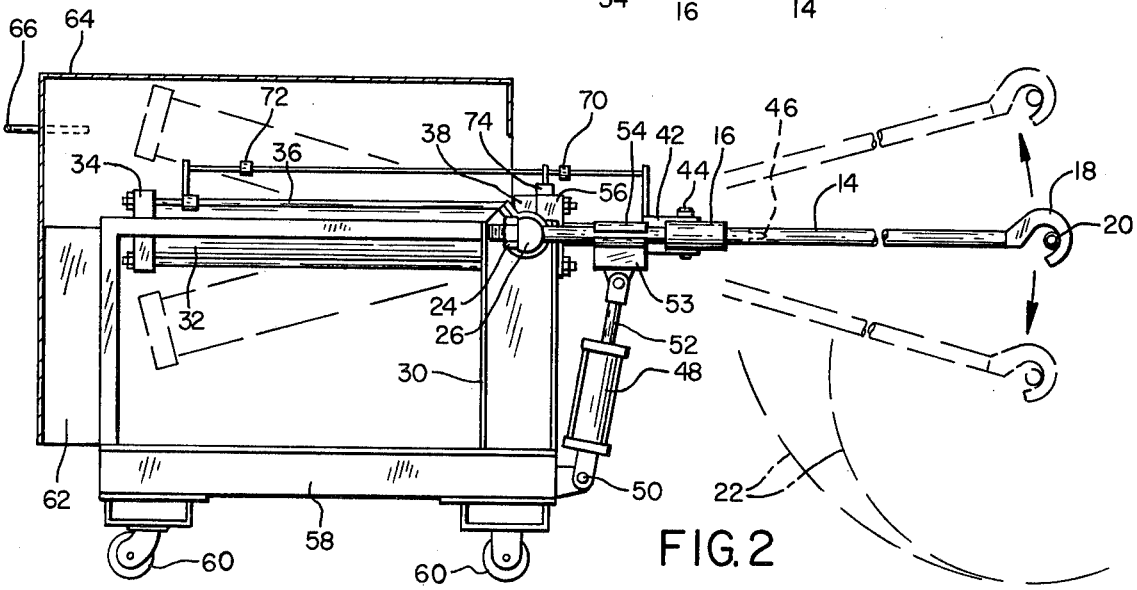
FIG. 2

SHEET ROLL SPLITTER HAVING HORIZONTAL CUTTER

BACKGROUND OF THE INVENTION

The subject matter of the present invention relates generally to apparatus for splitting rolls of sheet material, and in particular to a sheet roll splitter having a horizontal cutter which moves radially inward to cut the roll and horizontal holding arms for holding the roll during cutting. The present invention is especially useful for splitting rolls of paper into separate sheets which may then be fed to the chemical pulpers to turn the paper back into pulp, for reuse in the paper making process. The paper rolls which are so split are actually the unused remnants of larger rolls of greater length which are cut into a plurality of smaller rolls of different sizes determined by customer's orders. Thus, these remnant rolls, which are in effect waste paper, vary in length and diameter.

Previously, the sheet rolls have been split by vertical guillotine type cutters mounted on a stationary frame, after moving the rolls from the floor up onto such frame, as shown in U.S. Pat. No. 2,804,140 of Van Riper, issued Aug. 27, 1957 and U.S. Pat. No. 3,675,525 of Ellison, issued July 11, 1972. These vertical guillotine type roll splitters are large, permanently mounted installations which take up a lot of room and require that the heavy paper rolls be transported from the paper making machine to the cutter, which is difficult and time consuming. In addition, some of these roll splitters require that the roll be lifted vertically into position to be cut, which requires special equipment. Furthermore, vertical guillotine type cutters are dangerous since they can inadvertently fall by gravity and cut the operator, in the event of a mechanical or electrical failure. This hazard is eliminated using the horizontal cutter apparatus of the present invention.

Other safety hazards are eliminated using the present roll splitter, including those associated with manual splitting of rolls by axes, power saws, and knives. Power saws also create paper dust which is a health hazard and requires the use of a cumbersome respirator. In addition, the present invention is a mobile roll splitter which can be moved to the paper making machine being operated for splitting remnant rolls produced on such machine. Then the paper sheets from the split roll may be returned to the pulper supplying such machine to provide additional pulp of the same grade and color as the paper sheet being formed on such machine. Of course, this is not true of the vertical guillotine type roll splitters, which are mounted on a stationary frame away from the paper making machines so that the split roll sheets must be sorted in grade and color before sending them to the pulpers supplying such machines.

It has previously been proposed in U.S. Pat. No. 3,605,542 of Smith et al, issued Sept. 20, 1971, to provide a roll splitter which moves the cutter blade horizontally. However, unlike the present invention, the cutter of this apparatus moves longitudinally of the paper roll with a plow like motion during cutting and does not move radially inward towards the core during cutting. In addition, such apparatus employs a counter weighted mechanism for lifting the paper roll into position to be cut. As a result, such prior apparatus is considerably more complicated and requires more floor space for operation than the roll splitter apparatus of the present invention. In addition, such prior apparatus is not mobile but is fixedly mounted over the repulping machine, so that it has many of the disadvantages of the previously described vertical guillotine type apparatus.

SUMMARY OF INVENTION

It is therefore one object of the present invention to provide an improved apparatus for splitting rolls of sheet material which is safer and more economical to operate.

Another object of the invention is to provide such a roll splitter apparatus using a cutter blade which moves generally horizontally and radially inward toward the roll axis during cutting.

A further object of the present invention is to provide such a roll splitter apparatus with holding arms which extend generally horizontally and engage the opposite ends of a shaft extending through the core of the sheet roll to hold such roll during cutting.

An additional object of the present invention is to provide such a roll splitter apparatus which is mounted on a wheeled cart for mobile operation.

Still another object of the present invention is to provide such a roll splitter apparatus which is capable of splitting rolls of different diameter by means of a simple, relatively light weight and inexpensive apparatus, giving long trouble free operation.

A still further object of the invention is to provide such a roll splitter apparatus with an automatic operation in which the holding arms and cutter blades are raised and lowered by means of a fluid cylinder and the blade is moved to cut the roll by another fluid cylinder while such blade is guided for horizontal movement along the holding arms.

BRIEF DESCRIPTION OF DRAWINGS

Other objects and advantages of the present invention will be obvious from the following detailed description of certain preferred embodiments thereof and from the attached drawings of which:

FIG. 1 is an oblique elevation view of one embodiment of the roll splitter apparatus of the present invention with a portion of the cover broken away for purposes of clarity;

FIG. 2 is a side elevation view of the apparatus of FIG. 1, showing the movement of the holding arms by the raising cylinder;

FIG. 3 is a top elevation view showing the cutter blade in the extended and retracted positions;

DESCRIPTION OF PREFERRED EMBODIMENT

Figure 4:
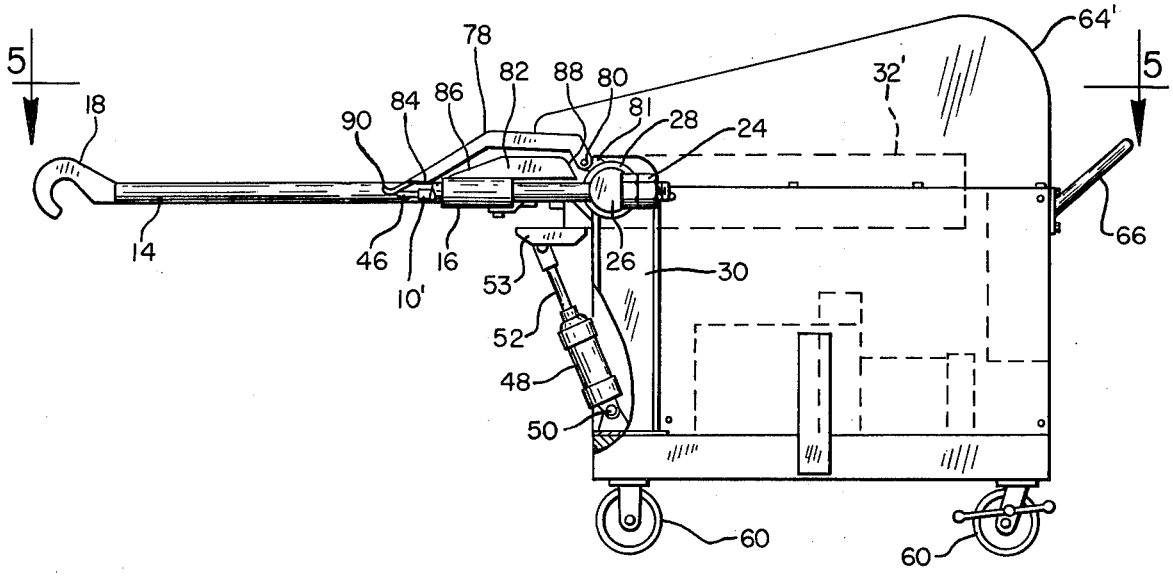
FIG. 4 is a side elevation view of a second embodiment of the roll splitter apparatus of the invention, employing two blade actuator cylinders, with parts broken away for clarity.

As shown in FIGS. 1, 2, and 3, one embodiment of the sheet roll splitter apparatus of the present invention includes a cutter blade member 10, mounted for generally horizontal sliding movement on a pair of holding arms 12 and 14, by means of a pair of guide sleeves 16 attached to the opposite ends of such blade. The outer ends of the holding arms 12 and 14 are provided with hooks 18 for engagement with a metal shaft 20 extending through the core of a roll 22 of sheet material, to hold such roll in position while it is being cut.

The opposite ends of the holding arms 12 and 14 are threaded and attached by nuts 24 to a pair of pivoted trunions 26. The trunions 26 are mounted within two bearing sleeves 28 attached to the apparatus support frame 30. A cutter actuator cylinder 32 is mounted on a support plate 34 attached by four tie rods 36 to a support block 38. The support block 38 is positioned between the two sleeves 28 and secured to the trunions 26 so that it pivots with such trunions for pivotal movement of the cylinder 32 in response to corresponding pivotal movement of the holding arms 12 and 14 and cutter blade 10. A piston rod 40 extends out of the cylinder 32 and is connected at its outer end to the center of the cutter blade 10 by means of a U-shaped connector 42, attached to such blade by a pivot pin 44. As a result, the cylinder 32 moves the cutter blade 10 horizontally back and forth between the extended position and retracted position shown in FIG. 3, to cut the sheet roll 22 with a removable knife edge 46 attached to the front of the cutter blade.

As shown in FIG. 2, the holding arms 12 and 14 and the cutter blade 10 are raised and lowered by an adjustment cylinder 48 to pivot such arms on trunions 26. The lower end of the adjustment cylinder 48 is pivotally supported by pivot pin 50 on the frame 30 of the roll splitter apparatus. The piston rod 52 of such cylinder is pivotally connected to a coupling member 53 whose opposite ends 54 are clamped to the holding arms 12 and 14 for raising and lowering such arms. A fluid actuator head 56 is attached to the support block 38 for supplying fluid to the actuator cylinder 32 by means of tubes and fittings attached to such head, which are not shown for purposes of clarity, to move the cutter blade 10 as previously described.

The roll splitter apparatus of FIGS. 1, 2, and 3 is mounted on a wheeled cart 58 having caster rollers 60 attached to the bottom of such cart. The frame 30 is secured to the cart as is the fluid pump for actuating cylinders 32 and 48 and the necessary fluid control apparatus and electrical control circuit, such control circuit being mounted within a housing 62 on the back of such cart. The entire roll splitter apparatus is contained within a rectangular cover 64 mounted on the top of cart 58 and provided with a hand rail 66 for moving the cart into the desired position.

A limit switch actuator rod 68 may be provided with one end mounted for sliding movement on the upper tie rods 36 and its other end attached to the connector 42 for movement with the cutter blade 10. The switch actuator rod is provided with two adjustable stops 70 and 72 for actuating a limit switch 74 on support block 56 which controls the actuator cylinder 32. The limit switch is actuated by stop 72 to prevent further cutting movement at the extended position and then causes the blade to return to the retracted position where stop 72 causes the switch to turn off the power supply when the cutter blade reaches the retracted position, as shown in FIG. 3.

Figure 5:
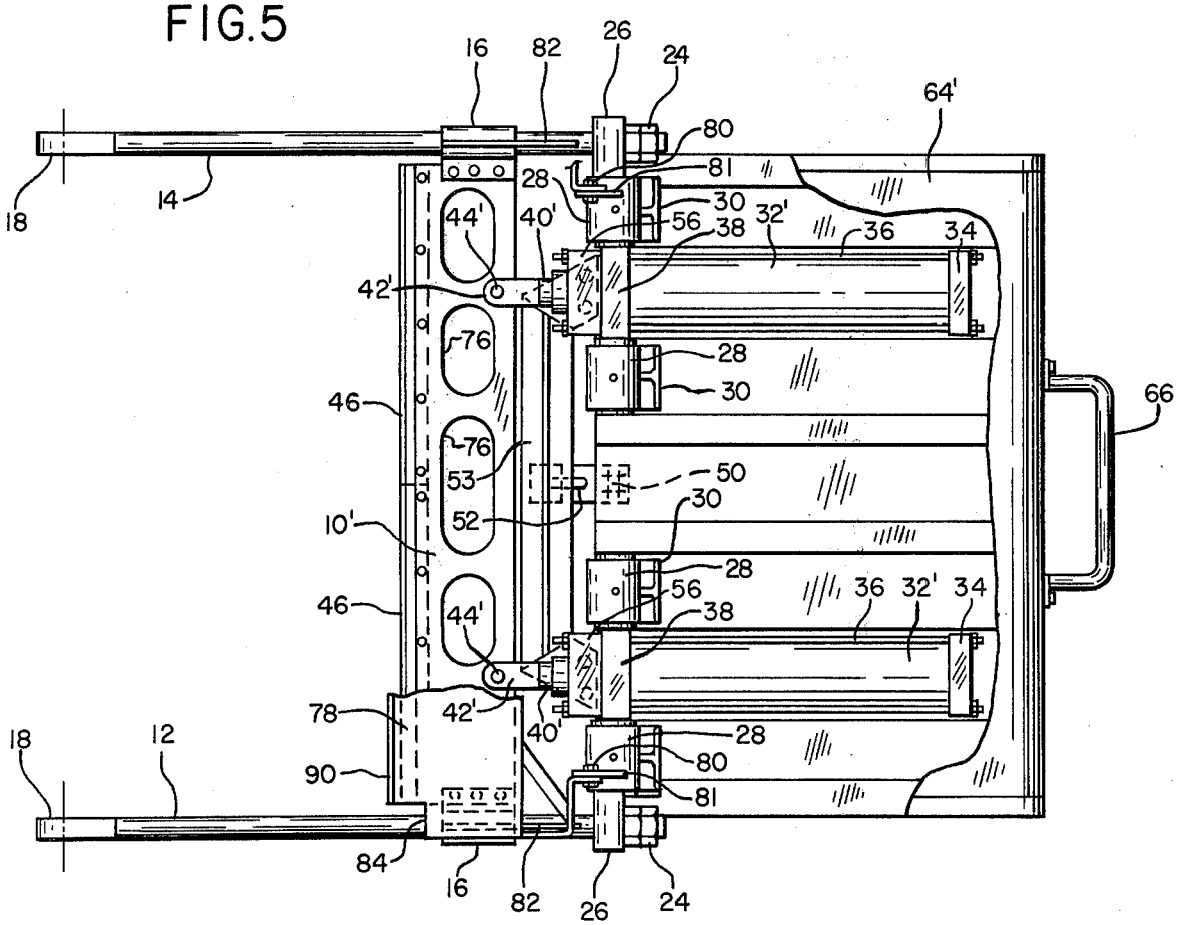
FIG. 5 is a horizontal section view taken along the line 5—5 of FIG. 4, with parts broken away for clarity.

FIGS. 4 and 5 show a second embodiment of the invention for cutting rolls up to 60 inches in length. This roll splitter apparatus employs two actuating cylinders 32' which have their piston rods 40' connected by connectors 42' to the cutter blade 10' at two separate points equally spaced on opposite sides of the center of such blade. As a result, the cylinders 32' push the blade evenly along the guides formed by the holding arms 14, to cut the larger roll in a smooth, trouble free manner. The embodiment of FIGS. 4 and 5 is similar to that of FIGS. 1 to 3 described above and for this reason the same reference numerals have been employed to designate like parts. Only the differences between these two embodiments will be discussed. In the embodiment of FIGS. 4 and 5, the limit switch 74 and actuator rod 68 and associated stops 70 and 72 are eliminated and replaced by limit switches within one of the cylinders 32'. These limit switches are actuated by the piston 40' within the cylinder 32' to provide a similar control action to the limit switch 74, described previously.

The cutter blade 10' is provided with a plurality of cutouts or holes 76 in order to lighten such blade, which would otherwise be extremely heavy due to its greater length.

A knife guard member 78 is employed in the embodiment of FIGS. 4 and 5 to cover the cutter blade 10' when such blade is in the retracted position shown. The knife guard is pivotally mounted at the rear end by pivots 80 provided on opposite sides of the cover, which attach such cover to support ears 81 on the outermost sleeve bearing members 28. A pair of cam projections 82 are provided on the upper surface of the guide sleeves 16 to raise and lower the knife guard 78 during movement of the cutter blade, such cam members moving with the cutter blade.

As shown in FIGS. 4 and 5, the knife guard 78 is provided with two cam follower surfaces 84 which are engaged by the sloping cam surfaces 86 at the left end of the cam members to raise the knife guard as it rotates about pivot 80 when the knife blade 10' moves from the retracted position shown toward its extended position. A second cam surface 88 on the right end of the cam member 82 engages the cam follower surface 84 and again raises the knife guard when the cutter blade 10' returns from its extended to its retracted position. The bottom of the cam follower 84 of the knife guard 78 rides along the upper surface of the cam member 82 and slides down cam surface 86, causing such guard to rotate counterclockwise about pivot 80, to close the knife guard. The knife guard 78 is provided with a curved knife engaging leading edge 90 which rests in contact with the knife 46 and causes no dulling of the knife edge, due to the upward curve to the left hand end of such member which enables it to slide across the knife edge.

It should be noted that the cover 64' for the apparatus in the embodiment of FIGS. 4 and 5 is slightly modified in order to accomodate movement of the knife guard 78. Also, each of the actuating cylinders 32' is supported at both ends by support blocks 34 and 38 and tie rods 36 so that it pivots on a support block 38 journaled between two bearing sleeves 28. This enables such cylinders to pivot in response to pivotal movement of the holding arms 14 by means of the adjusting cylinder 48.

It will be obvious to those having ordinary skill in the art that many changes may be made in the above described preferred embodiment of the present invention without departing from the spirit of the invention. For example, the cutter blade and the holding arms can be moved by electric motors and a suitable gearing, rather than by means of fluid cylinders, as shown. Therefore, the scope of the present invention should only be determined by the following claims.

I claim:

1. Roll splitter apparatus for cutting a roll of sheet material, comprising:

roll engaging means provided at the opposite ends of the roll;

cutter means including a blade mounted on support means for substantially horizontal movement of said blade;

holding means for gripping said roll engaging means at the opposite ends of the roll and for holding said roll against horizontal movement away from the cutter; and drive means for moving said blade from a retracted position to an extended position toward said roll to cut the sheet material as the blade moves radially inward toward the center of the roll.

2. Splitter apparatus in accordance with claim 1 which also includes adjustment means for raising and lowering the blade support means to enable the cutting of rolls of different diameter.

3. Splitter apparatus in accordance with claim 1 in which the holding means includes a pair of gripping arms each having one end adapted to engage a shaft extending through the center of said roll.

4. Splitter apparatus in accordance with claim 3 in which the gripping arms also support the blade and guide the horizontal movement of said blade.

5. Splitter apparatus in accordance with claim 4 in which the gripping arms have hooks on said one ends and are mounted on a pivot means adjacent their other ends to enable said arms to be raised and lowered by said adjustment means.

6. Splitter apparatus in accordance with claim 1 in which the drive means is a fluid cylinder means connected to the blade for movement of such blade.

7. Splitter apparatus in accordance with claim 2 in which the adjustment means is a fluid cylinder.

8. Splitter apparatus in accordance with claim 1 which also includes a mobile carriage on which the apparatus is mounted.

9. Splitter apparatus in accordance with claim 8 in which the carriage is a wheeled cart.

10. Splitter apparatus in accordance with claim 5 in which the pivot means also mounts a fluid cylinder whose piston rod is connected to the blade as said drive means.

11. Splitter apparatus in accordance with claim 1 which includes a cam actuated cutter blade guard pivotally mounted to cover said blade in its retracted position and to pivot open to uncover said blade as it moves from said retracted to said extended position.

12. Splitter apparatus in accordance with claim 1 which includes limit switch means for controlling said drive means to limit the movement of said blade between said extended and retracted positions.

* * * * *